United States Patent [19]

Sentmore, Sr. et al.

[11] Patent Number: 4,823,848

[45] Date of Patent: Apr. 25, 1989

[54] MULTIPURPOSE FUNNEL

[76] Inventors: Darryl J. Sentmore, Sr.; Marrilyn M. Sentimore, both of #2 Christopher Ct., New Orleans, La. 70128

[21] Appl. No.: 160,298

[22] Filed: Feb. 25, 1988

[51] Int. Cl.[4] ..... B65B 39/00; B67C 11/00

[52] U.S. Cl. ..... 141/334

[58] Field of Search ..... 141/236, 331, 340, 334

[56] References Cited

U.S. PATENT DOCUMENTS 699,917 5/1902 Gruenebaum ..... 141/236 X 4,600,125 7/1986 Maynard, Jr. ..... 141/331 X

*Primary Examiner*—William A. Cuchlinski, Jr.

*Attorney, Agent, or Firm*—Leon Gilden

[57] ABSTRACT

A multipurpose funnel is designed to be threadably attached to the top of a container to thus facilitate the filling of the container with a chosen material. Interchangeable internally threaded caps may be used in combination with the funnel to permits its attachment to various sized containers having conventional closure-engaging external threads. When not threadably attached to a container, interchangeable neck portions may be threadably attached to the funnel. At least one neck section is of a bifurcated design to facilitate the filling of two containers at the same time.

1 Claim, 4 Drawing Sheets

MULTIPURPOSE FUNNEL

BACKGROUND OF THE INVENTION

1. Field of the Invention

The present invention relates to funnels, and more particularly pertains to a new and improved multipurpose funnel which may be directly threadably attached to the top of a conventional container.

2. Description of the Prior Art

The prior art is replete with examples of multipurpose funnels. For example, U.S. Pat. No. 4,338,983, which issued to F. Hatcher on July 13, 1982, discloses a funnel permanently attached to an engine oil cap. The oil cap is attachable to the engine oil receiving opening in place of a conventional cap, and an aperture in the cap receives a neck portion of the funnel. The funnel portion is provided with a cover which may then be removed to add engine oil. As such, the Hatcher funnel discloses the concept of fixedly securing the same to an externally threaded closure with the closure then being directly connectable to a container. While being functional for its intended purpose, the Hatcher funnel is designed in a manner which limits its versatility of use. More particularly, the associated oil cap is not designed to be utilized on different types of containers, and no provision is made for interchanging the associated caps to thus allow an expanded use of the funnel with various sized containers. Additionally, the complete funnel assembly is substantially complex in construction and is most likely expensive to manufacture.

Accordingly, there would appear to be continuing need for new and improved multipurpose funnels which would permit a more versatile use thereof with respect to various sized commercially available containers, and in this respect, the present invention substantially addresses this need.

SUMMARY OF THE INVENTION

In view of the foregoing disadvantages inherent in the known types of multipurpose funnels now present in the prior art, the present invention provides an improved multipurpose funnel construction wherein the same can be interchangeably connected to various sized threaded openings associated with commercially of variously designed funnel necks.

To attain this, the present invention comprises a funnel member removably attachable to a threaded cap wherein the threaded cap is designed to be threadedly connected to a conventional container. Various sizes of threaded caps may be provided so that an appropriate size can be utilized with respect to the container at issue and additionally, the interchangeable neck portions can also be utilized in the combination of the invention. Through the use of the interchangeable necks, the funnel can be used without the necessity of threadably attaching it to a container. At least one neck portion is of a bifurcated design to facilitate the simultaneous filling of two containers. In its preferred embodiment, the funnel neck is substantially larger than most commercially available funnels to thus allow bulky material, such as grapes, rice, and the like, to be directed into a container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multipurpose funnel which has all the advantages of the prior art multipurpose funnels and none of the disadvantages.

It is another object of the present invention to provide a new and improved multipurpose funnel which may be easily and efficiently manufactured and marketed.

It is a further object of the present invention to provide a new and improved multipurpose funnel which is of a durable and reliable construction.

An even further object of the present invention is to provide a new and improved multipurpose funnel which is susceptible of a low cost of manufacture with regard to both materials and labor, and which accordingly is then susceptible of low prices of sale to the consuming public, thereby making such multipurpose funnels economically available to the buying public.

Still yet another object of the present invention is to provide a new and improved multipurpose funnel which provides in the apparatuses and methods of the prior art some of the advantages thereof, while simultaneously overcoming some of the disadvantages normally associated therewith.

Still another object of the present invention is to provide a new and improved multipurpose funnel which may be threadably connected to a container prior to its use.

Yet another object of the present invention is to provide a new and improved multipurpose funnel which makes use of differently sized and designed necks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
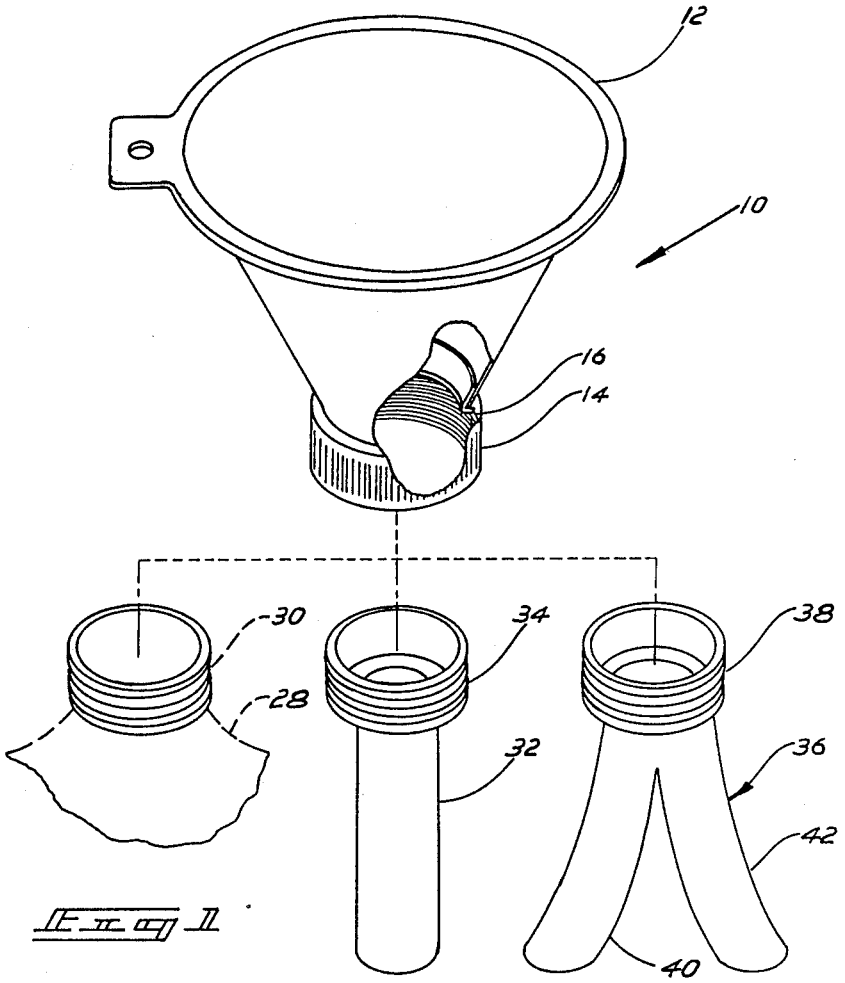
FIG. 1 is a perspective view of the multipurpose funnel comprising the present invention.
Figure 2:
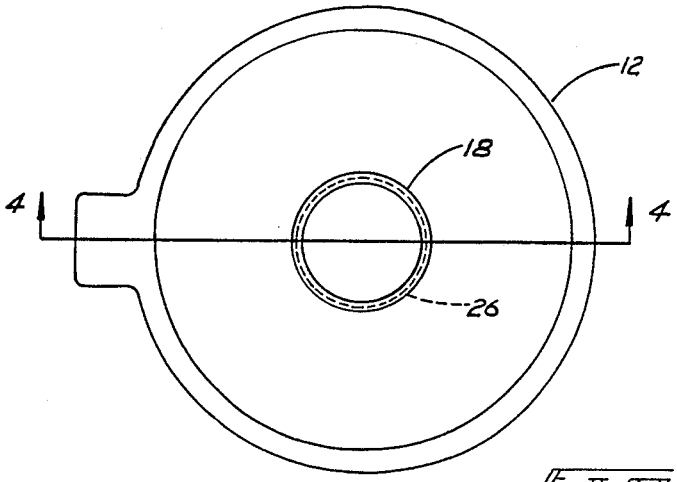
FIG. 2 is a top plan view of the funnel.
Figure 3:
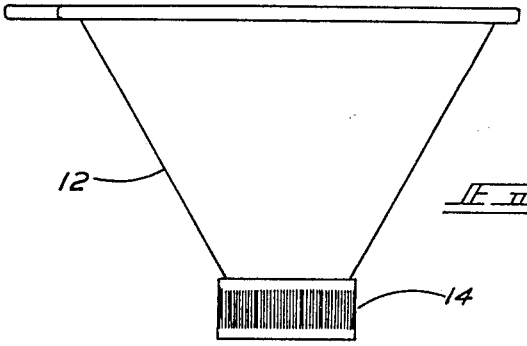
FIG. 3 is a side elevation view of the funnel.
Figure 4:
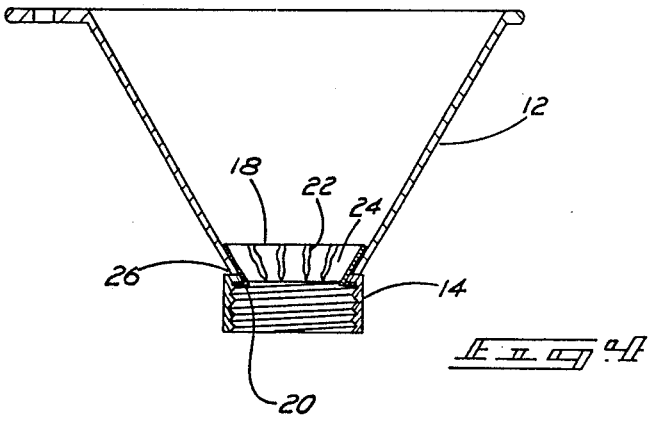
FIG. 4 is a cross-sectional view of the funnel as viewed along the line 4—4 illustrated in FIG. 2.

With reference now to the drawings, and in particular to FIGS. 1, 2, 3 and 4 thereof, a new and improved multipurpose funnel embodying the principles and concepts of the present invention and generally designated by the reference numeral 10 will be described.

More specifically, it will be noted that the multipurpose funnel 10 essentially comprises a conventionally shaped funnel member 12 to which an internally threaded closure or cap 14 is fixedly secured. The funnel member 12, as well as all of the other components of the invention, yet to be described, may be formed from any conventional material such as plastic, metal, or the like. Accordingly, all such materials are within the intent and purview of the claims appended hereto.

The internally threaded cap members 14 may be provided in a variety of different sizes so as to accommodate their threaded attachment to variously sized and readily available containers. Each internally threaded cap 14 is provided with a topmost opening 16 into which a funnel shaped flexible insert 18 may be snap fitted. The flexible insert 18 includes a radially extending integral flange 20 designed to engage an internal radial surface of the cap 14 in the manner best illustrated in FIG. 4. Additionally, each insert 18 includes a plurality of slits 22 extending downwardly along sidewall portions 24 of the insert, and these slits permit the resilient deformation of the insert 18 so as to allow it to be engagingly positioned through the lowermost opening 26 of the funnel 12. As such, the flange 20 facilitates the attachment of the insert 18 to the cap 14, while the flexibly deformable sidewalls 24 of the insert then engage the funnel 12 to thereby effect a desired fixed securement between the funnel and cap. The funnel 12 may now be utilized to fill a container 28 by threadably attaching the cap 14 directly to the external threads 30 associated with the container.

Figure 5:
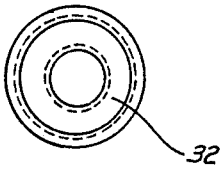
FIG. 5 is a top plan view of a first neck design utilized in the combination of the invention.
Figure 6:
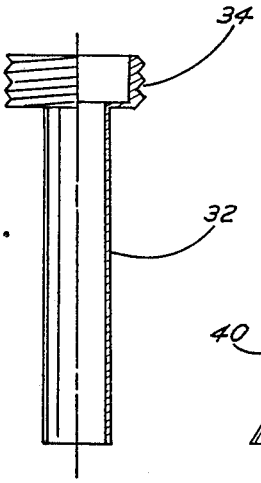
FIG. 6 is a side elevation view, partly in cross section, of the neck member shown in FIG. 5.

Recognizing that it may not always be desirable to threadably attach the funnel 12 to a container 28, the present invention further envisions the use of a selectively connectable neck portion 32. More specifically, reference is made to FIGS. 1, 5 and 6 where it can be seen that the funnel neck 32 is provided with external threads 34 which facilitate its threaded connection directly to the funnel cap 14. When the funnel neck 32 is threadably attached to the funnel 12, the funnel resembles and may be used in the manner of a conventional and commercially available funnel.

Figure 7:
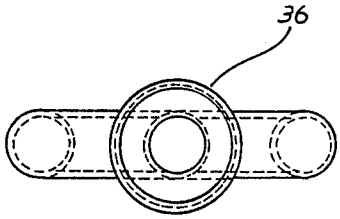
FIG. 7 is a top plan view of a second funnel neck used in the combination of the present invention.
Figure 8:
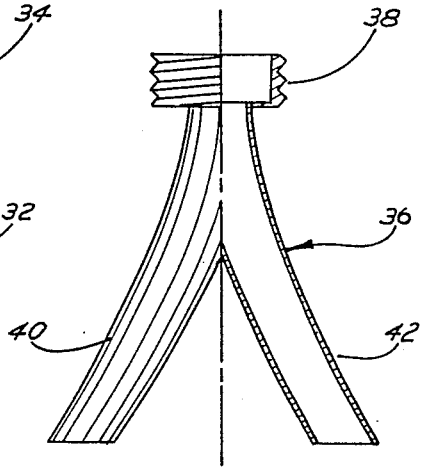
FIG. 8 is a side elevation view, partly in cross section, of the neck shown n FIG. 7.

Inasmuch as the present invention envisions the manufacturing of funnel portions in an expanded size, thereby to facilitate the filling of large or bulky materials such as grapes, rice, or the like into containers 28, it may at times become desirable to fill at least two containers simultaneously. To accommodate this need, reference is made to FIGS. 1, 7 and 8 wherein a modified funnel neck 36 is illustrated. As shown, the funnel neck 36 includes external threads 38 to facilitate its attachment to the internal threads associated with the cap 14, and further includes a bifurcated neck design which results in the use of two funnel necks 40, 42. As is now apparent, the bifurcated funnel neck 36 is designed to facilitate a usage of the funnel 12 in a manner which allows the simultaneous filling of two separate containers 28. In this regard, the funnel neck portion 40 is inserted into one container 28 while the funnel neck 42 is inserted into a separate container, thereby to permit the double container filling operation.

With respect to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved multipurpose funnel comprising:

funnel means; and neck means removably attached to said funnel means configured for selective engagement with a container opening to facilitate a filling thereof with a chosen material wherein said neck means includes an internally threaded closure removably attached to said funnel means;

said internally threaded closure comprises a container cap, and wherein said container cap includes a topmost positioned through-extending aperture, said funnel means being positionable within said aperture, and further including a funnel shaped insert removably interconnected between said funnel means and said container cap, said insert comprising an attachment means between said funnel means and said container cap, and wherein said neck means further includes a neck portion threadably attachable thereto, and wherein said neck portion includes external threads which are engageable with internal threads formed in said internally threaded closure, and wherein said neck portion is of a bifurcated design which includes a first neck directable to a first container and a second neck directable to a second container, thereby to facilitate the concurrent filling of said first and second containers with a selected material.

* * * * *